US005613396A

United States Patent [19]

Futamura et al.

[11] Patent Number: 5,613,396

[45] Date of Patent: Mar. 25, 1997

[54] INDEX-FEED MACHINING SYSTEM

[75] Inventors: Shoji Futamura; Chikara Murata, both of Kawasaki, Japan

[73] Assignee: Institute of Technology Precision, Kanawa-ken, Japan

[21] Appl. No.: 506,809

[22] Filed: Jul. 25, 1995

Related U.S. Application Data

[62] Division of Ser. No. 962,253, Oct. 16, 1992, Pat. No. 5,473,926.

[30] Foreign Application Priority Data

| | | | |
|---|---|---|---|
| Oct. 18, 1991 | [JP] | Japan | 3-269830 |
| Oct. 18, 1991 | [JP] | Japan | 3-269831 |
| Mar. 31, 1992 | [JP] | Japan | 4-74864 |
| May 15, 1992 | [JP] | Japan | 4-122369 |

[51] Int. Cl.[6] ..... B21J 7/28

[52] U.S. Cl. ..... 72/404; 72/453.07; 72/453.08

[58] Field of Search ..... 72/453.08, 453.07, 72/453.06, 453.18, 453.01, 453.02, 404, 405

[56] References Cited

U.S. PATENT DOCUMENTS

| | | | |
|---|---|---|---|
| 3,839,896 | 10/1974 | Hamada | 72/443 |
| 4,079,617 | 3/1978 | Whiting | 72/453.07 |
| 4,125,010 | 11/1978 | Adam | 72/453.08 |
| 4,235,088 | 11/1980 | Kreiskorte | 72/453.07 |

FOREIGN PATENT DOCUMENTS

| | | | |
|---|---|---|---|
| 392952 | 12/1908 | France | 72/453.06 |
| 3715261 | 10/1988 | Germany | 72/453.18 |

*Primary Examiner*—Daniel C. Crane
*Attorney, Agent, or Firm*—McGlew and Tuttle

[57] ABSTRACT

An index-feed machining system having such a construction that a plurality of machining units on which a cassette incorporating a plurality of machining means is detachably mounted are disposed at intervals of mp (m being a given positive integer, p being a workpiece-feeding pitch) in the workpiece-feeding direction corresponding to a plurality of machining processes; the machining processes being sequentially performed by the machining units at the workpiece-feeding pitches, in which drive means for driving the machining means are provided in the cassette comprising a plurality of machining units, and the driving force of the driving means of a particular machining unit is made larger than the driving force of the driving means of other machining units.

2 Claims, 8 Drawing Sheets

INDEX-FEED MACHINING SYSTEM

This is a divisional application of application Ser. No. 07/962,253 filed Oct. 16, 1992, now U.S. Pat. No. 5,473, 926, the contents of which are incorporated herein by reference.

BACKGROUND OF THE INVENTION

This invention relates to an index-feed machining system for performing punching, bending, drawing and other types of machining on a workpiece, for example, in a set of systems by sequentially performing different types of machining while index-feeding the workpiece to the succeeding machining processes to complete the entire machining process in the final process.

DESCRIPTION OF THE PRIOR ART

To manufacture sheet-metal products of a predetermined shape by performing punching, bending, drawing, compressing and other types of machining on a sheet-metal blank, such as a steel sheet, the workpiece has heretofore been subjected to several processes. When a large quantity to sheet metal products are involved, a means for performing several processes or stages in a single machining metal die by sequentially feeding the workpiece to the succeeding stages to complete the entire machining process in the final stage has been adopted. This type of multi-stage machining metal die, called the progressive die, has an advantage of high efficiency because one sheet-metal product can be produced with one stamping stroke of the press.

While the conventional type of progressive die, described above, has advantages of high production rates, short delivery time involved from the charging of a workpiece to the completion of machining, and less work in process, and volume production possible with a small number of workers, it has the following problems. The construction of the metal die becomes extremely complex because a plurality of punch-die sets are incorporated in a single metal die, requiring a high level of metal-die manufacturing technology, leading to prolonged manufacturing time and increased manufacturing cost.

To replace, repair the damaged metal die, and adjust part of the metal die, the entire metal die has to be disassembled, involving troublesome work, and much time and labor accordingly. Furthermore, in a production system where a wide variety of products are manufactured in a small quantity, specially prepared metal dies have to be manufactured every time the shapes and sizes of workpieces are changed even only slightly. This leads to increased metal-die cost, and makes it difficult to adapt to the so-called flexible manufacturing system (FMS) the need for which has been increasing in recent years.

To solve these problems, the present Applicant has filed a patent application for an index-feed machining system which is simple in construction and can easily perform partial adjustment (Japanese Patent Application Nos. 121760/1990 and 121761/1990, for example). The present invention represents further improvements on these improvement inventions.

FIG. 1 is a perspective view illustrating the essential part of an example of index-feed machining system on which this invention is based. In FIG. 1, numerals 100–500 denote machining units disposed on a base 1 at intervals of 2P (P being a workpiece-feeding pitch) in the direction in which a workpiece (not shown) is fed. A pair of punch and die is provided in each of these machining units 100–500 for a plurality of machining processes. Now, the construction of this invention will be described, taking the machining unit 100 as an example. Numeral 101 denotes a machining unit body formed into an essentially U shape, and having a dovetail 102 integrally provided at the lower end thereof for engaging with a dovetail groove 103 provided on the base 1 so that the machining unit 100 can be adjusted for movement in the workpiece-feeding direction, and at the same time can be limited in movement in the direction normal to the workpiece-feeding direction. Numeral 104 denotes a movement adjusting device; 105 a clamp; 106 a hydraulic cylinder provided at the upper end of the machining unit body 101; and 107 a position measuring device provided on the side surface of the hydraulic cylinder 106.

Numeral 108 denotes a cassette formed into an essentially U shape and detachably provided on the machining unit body 101, on the upper part of which vertically movably provided is a punch or die (not shown), and on the lower part of which provided is a die or punch (not shown) forming a pair with the aforementioned punch and die. The cassette 108 is positioned by engaging with positioning members 309 and 310, as shown in the machining unit 300 in the figure. Numeral 111 denotes a clamp screw. The cassette 108 is mounted and positioned at a predetermined location on the machining unit body 101 via positioning members (not shown. See numerals 309 and 310 in the machining unit 300.) and securely held in position by tightening the clamp screw 111. After the cassette 108 has been fixedly fitted to the machining unit body 101, the operating piston (not shown) of the hydraulic cylinder 106 is connected to the vertically movable punch or die described above.

FIGS. 2A and 2B are diagrams of assistance in explaining the state where a workpiece is machined; FIG. 2A being a plan view and FIG. 2B a cross-sectional view. Like parts are indicated by like numerals shown in FIG. 1. In FIGS. 2A and 2B, numeral 2 denotes a workpiece intermittently fed at a pitch of P in the direction shown by an arrow in the figure. That is, the workpiece 2 is index-fed in a gap between a pair of punch and die provided in the cassette 108 (similarly with other cassettes) in FIG. 1 above. In FIGS. 1 through 2B, the machining units 100–500 are formed so as to correspond to the punching process of pilot holes 3, the notching process of arc-segment-shaped notches 4 and the first to third drawing processes.

The machining unit 100 has a punch and die for punching the pilot holes 3, and guides (not shown) engaging with the pilot holes 3 at intervals of P on the downstream side in the direction in which the workpiece 2 is fed. Consequently, as the machining unit 100 is operated, the pilot holes 3 are sequentially punched, and the guides are engaged with the punched pilot holes 3 to prevent the workpiece 2 from unwantedly deviating from the predetermined location thereof, thereby keeping accuracy.

Next, arc-segment-shaped notches 4 are formed in the machining unit 200, the first drawing operation is performed in the machining unit 300 to form a cup-shaped projection 5 while the arc-segment-shaped notches 4 are expanded in width, changing into arc-segment-shaped grooves 6. In the machining-unit 400, the second drawing operation and the forming of flange holes 7 are performed, and the height of the projection 5 is increased. The third drawing is performed in the machining unit 500 to form the projection to a predetermined height. Though not shown in the figures, edge-cutting and other operations are carried out to obtain a sheet-metal product of a predetermined cup shape. Needless to say, positioning to maintain predetermined accuracy is also carried out in the machining units 200–500 by providing guides engaging with the pilot holes 3.

The index-feed machining system having the aforementioned construction is simple in construction, compared with conventional progressive dies, and easy to manufacture. It has an advantage in that high-efficiency machining can be achieved even in a production system in which a wide variety of products are manufactured in a small quantity, but the following problems are encountered.

That is, independent special-purpose hydraulic cylinders 106 and other equipment are provided in a plurality of machining units, as shown in FIG. 1. While this arrangement permits the independent operation of the units and the standardization of common components for interchangeability, if a particular machining unit requires a larger drive force or working load than other units, a hydraulic cylinder of a special specification must be provided for that machining unit. This would not only increase manufacturing cost but also make it difficult to keep balance with other hydraulic cylinders.

Although means for reducing drive force or working load by dividing the particular machining process into multiple steps can be conceived, this arrangement would increase the number of machining processes, requiring additional machining units to be installed. All this leads to increased cost and system size.

In addition, although the machining units 100–500 as shown in FIG. 1 above are driven by the hydraulic cylinder 106, etc., the piston or plunger for operating the actuator in this type of conventional hydraulic cylinders usually has the same stroke for each machining unit. In other words, despite the fact that the punching or piercing of a workpiece requires only a punch stroke slightly larger than the thickness of the workpiece, the stroke of hydraulic cylinders for such piercing and punching operations is set to the same as that in other machining units for bending, drawing and other machining operations. Thus, the consumption of operating fluid for the entire system tends to be larger, requiring a hydraulic pump of a larger capacity.

In addition, the operating fluid of hydraulic cylinders is usually maintained at the same pressure, a pressure as high as 140 kg/cm$^2$ for example. In machining the workpiece as described above, however, operating fluid is required to be at a high level only when bending, drawing, punching or piercing operation is performed, but operating fluid need not always to be operated at high pressure to cause the punch or die to come near or keep away from the workpiece. In hydraulic cylinders, on the other hand, a large amount of energy is required to raise the pressure of the operating fluid. Since conventional hydraulic cylinders require high-pressure operating fluid at all times, and involve larger strokes than needed, the required amount of operating fluid is increased, and accordingly energy consumption is increased.

SUMMARY OF THE INVENTION

It is the first object of this invention to provide an index-feed machining system having such a construction that the drive force or working load of a particular machining unit can be selectively increased.

It is the second object of this invention to provide an index-feed machining system that can control the stroke of machining means in accordance with their respective machining processes, and reduce energy consumption.

DETAILED DESCRIPTION OF THE EMBODIMENTS

Figure 2A:
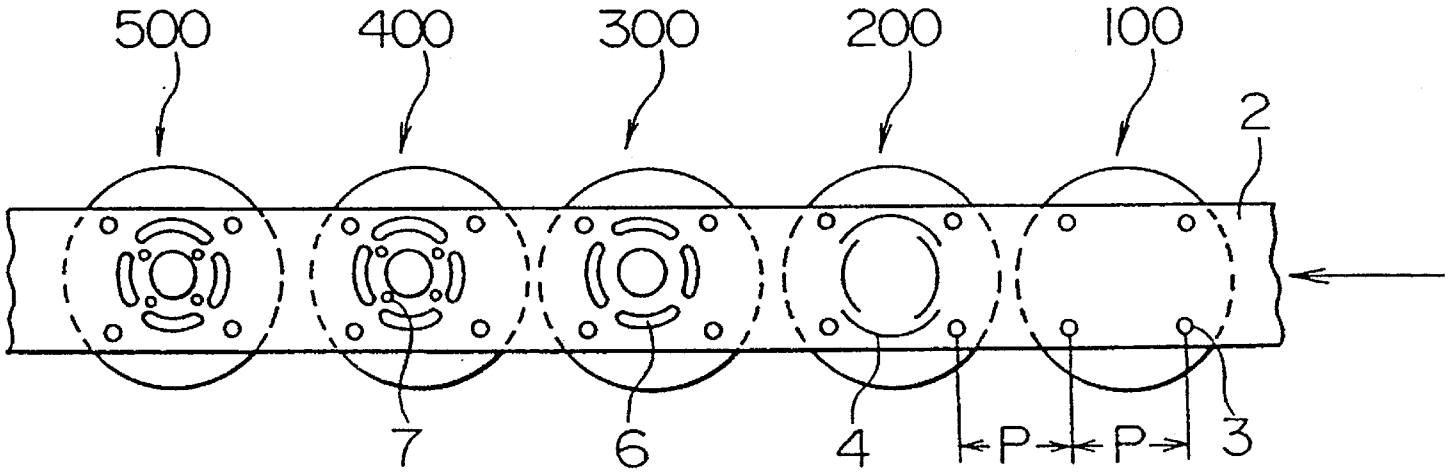
FIGS. 2A and 2B are a plan view and cross-sectional view illustrating the machining state of a workpiece.
Figure 2B:
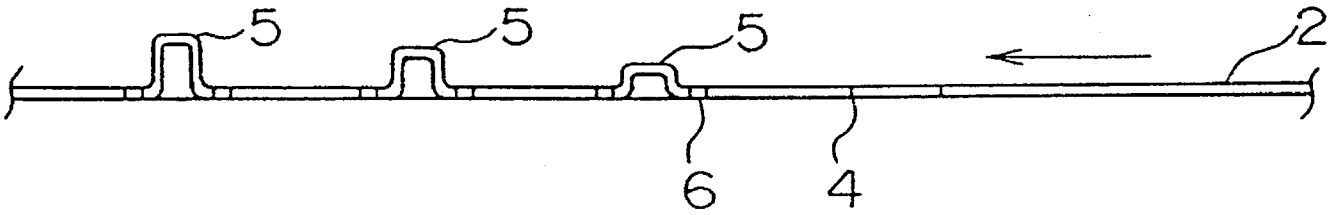
Figure 3:
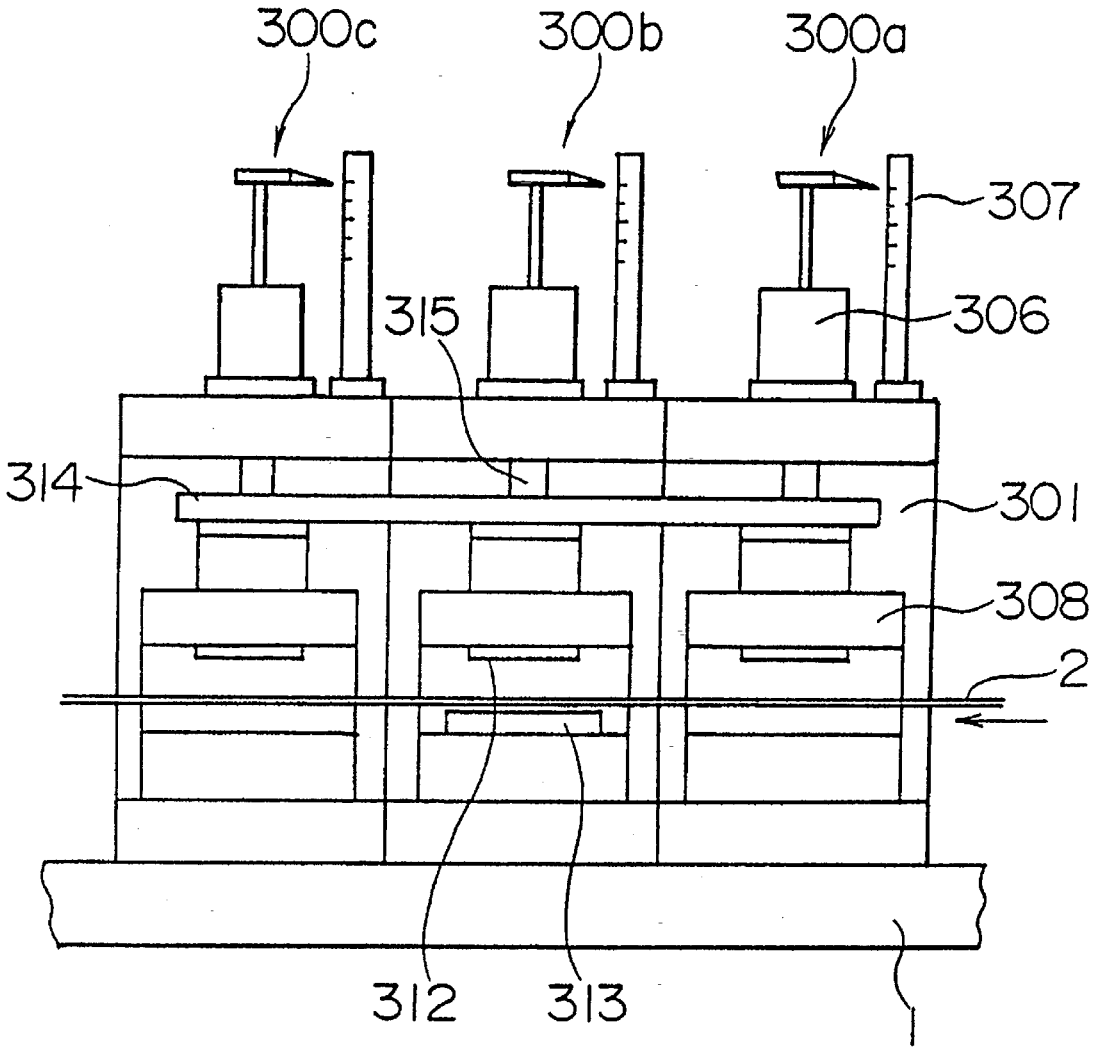
FIG. 3 is a front view illustrating the essential part of the first embodiment of this invention.

FIG. 3 is a front view illustrating the essential part of the first embodiment of this invention. Like parts are indicated by like reference numerals in FIGS. 1, and 2A and 2B. In FIG. 3, three machining units of the same construction are provided adjacently on a base 1, and indicated by numerals 300*a*, 300*b* and 300*c*. In FIG. 3, the machining unit body 301 is mounted on a base 1 via a dovetail (not shown) engaged with a dovetail groove (not shown) provided on the base 1. A cassette 308 having a punch 312, which is formed in a vertically movable manner and a die 313 forming a pair with the punch 312, is detachably provided on the machining unit body 301. Numeral 306 denotes a hydraulic cylinder, and 307 a position measuring device provided on the upper end of the machining unit body 301. In FIG. 3, only the machining unit 300*b* at the center is constructed to contribute to machining. Therefore, dies are not provided in the machining units 300*a* and 300*c*. Numeral 314 denotes a linkage member connecting the actuating rods 315 of the three hydraulic cylinders 306 in such a manner as to collaborate with each other.

Figure 1:
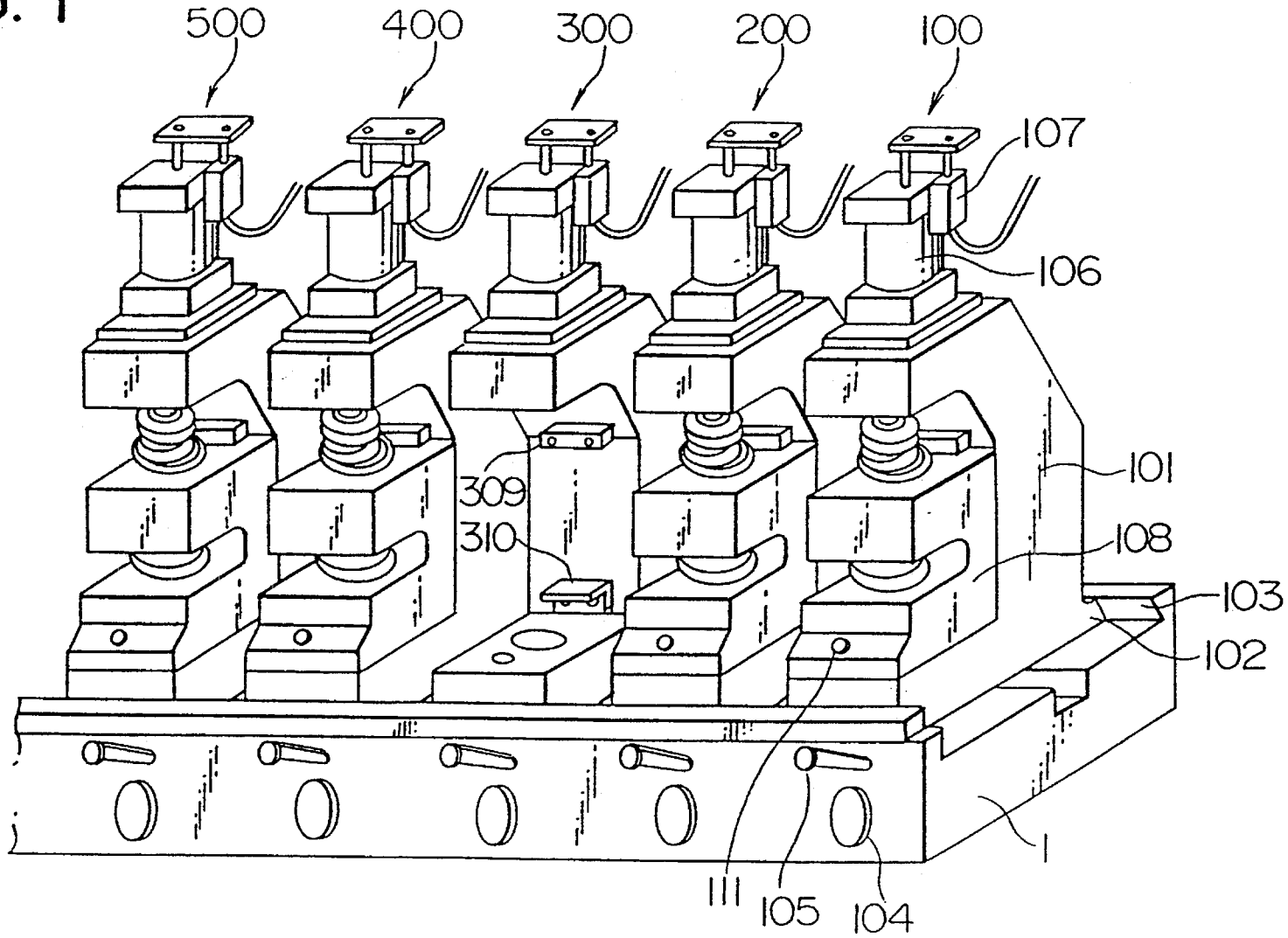
FIG. 1 is a perspective view illustrating the essential part of an index-feed machining system on which this invention is based.

With the above-mentioned construction, the index-feed machining as shown in FIGS. 1, and 2A and 2B is made possible by index-feeding the workpiece 2 in the direction shown by an arrow. In the machining unit 300*b* shown in FIG. 3, a larger driving force than in any other machining units can be obtained. That is, assuming that the normal driving force is W, the machining unit 300*b* has a driving force of 3W. In general, when n pieces of machining unit hydraulic cylinders are connected by the linkage member 314 to drive s pieces of machining unit movable punches (or movable dies), the driving force of each movable punch can be increased to nW/s times.

Figure 4:
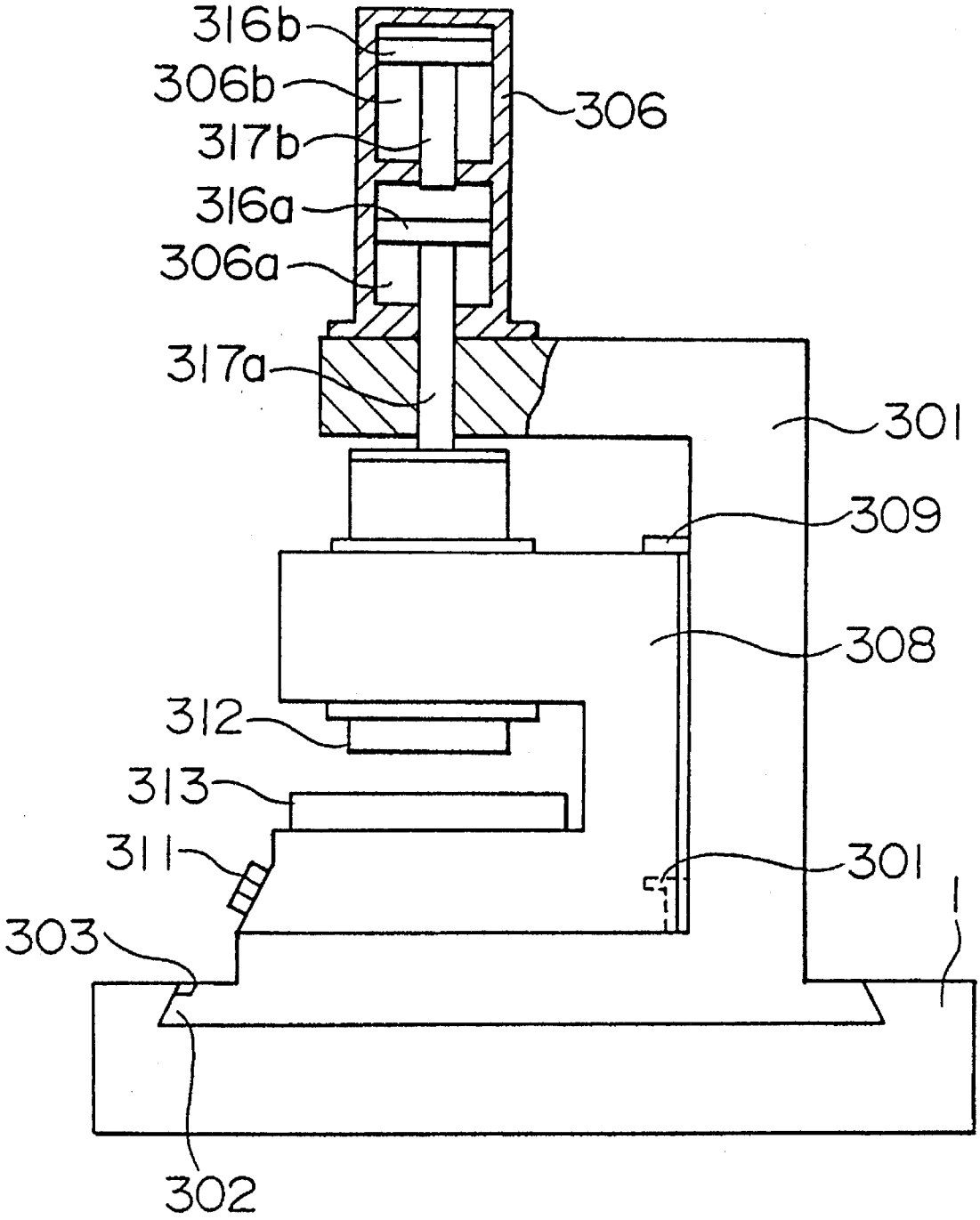
FIG. 4 is a partly cross-sectional side view illustrating the essential part of the second embodiment of this invention.

FIG. 4 is a partly cross-sectional front view illustrating the second embodiment of this invention. Like parts are indicated by like reference numerals in FIGS. 1 and 3. In FIG. 4, a machining unit body 301 is mounted on a base 1 by engaging a dovetail 302 with a dovetail groove 303 provided on a base 1, and fixedly fitted with a clamp screw 311. A hydraulic cylinder 306 is formed by connecting a first cylinder 306*a* and a second cylinder 306*b* in series, in which pistons 316*a* and 316*b* are fitted. A piston rod 317*a* is connected to a punch 312, whereas a piston rod 317*b* is provided in the first cylinder 306 and formed so as to be approachable to and detachable from the piston 316*a*. The first cylinder 306*a* and the second cylinder 306*b* are constructed so that hydraulic pressure can be applied simultaneously or individually via a control device (not shown).

With the aforementioned construction, if machining is possible with the normal driving force, machining is carried out by operating the punch 312 only by means of the first cylinder 306*a* by shutting off the hydraulic pressure to the second cylinder 306*b*. Where a larger driving force is needed, the control device is operated so that hydraulic pressure is applied to the second cylinder 306*b*. This causes the piston 316*b* to operate, causing the piston rod 317*b* to make contact with the piston 316*a* to jointly operate the punch 312. In general, when n pieces of cylinders having the same driving force are connected in series, and s pieces of cylinders (the driving force of each cylinder being W) are selectively operated from the side closer to the punch 312, a driving force of sW can be obtained, with the range of driving force selection being W–nW.

In this embodiment, description has been made about punching operation, but the same can be applied to drawing, bending and compressing operations. Description has also been made about the use of oil-hydraulic cylinders as the driving means, but fluid-pressure cylinders using air, water, etc., or any driving means other than fluid-pressure cylinders may be used. Although the intervals of the machining units can generally be mP (m being a positive integer), the intervals may be varied as necessary.

Figure 5:
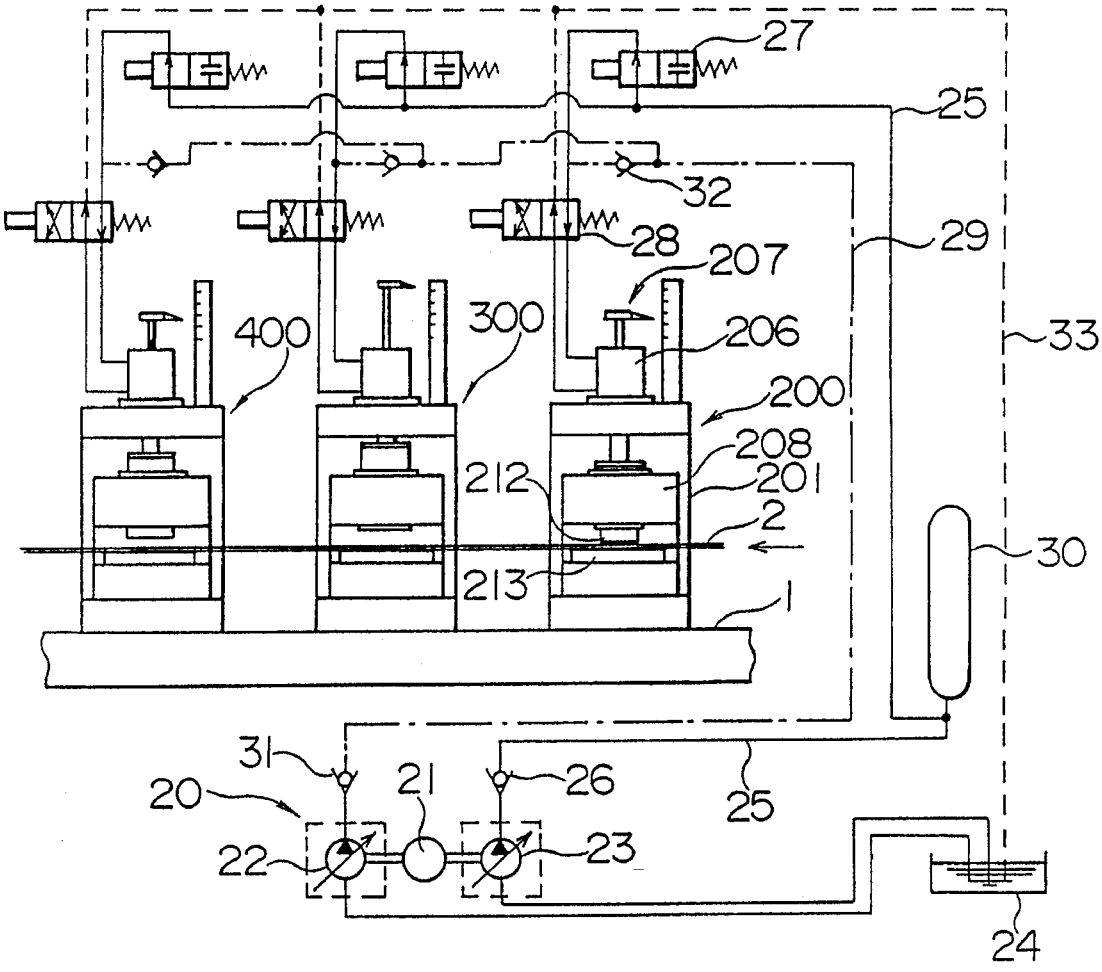
FIG. 5 is a diagram of assistance in explaining the third embodiment of this invention.

FIG. 5 is a diagram of assistance in explaining the third embodiment of this invention. Like parts are indicated by like numerals in FIGS. 1, and 2A and 2B. In FIG. 5, machining units 200, 300 and 400 correspond with the notching process, the first drawing process, and the second drawing process in FIGS. 1 and 2A, and disposed on the base 1 at intervals of mP. Since the machining units 200–300 have almost the same construction, and are similar to those shown in FIGS. 1 and 2A, description will be made taking the machining unit 200 as an example.

A cassette 208 having a punch 212 and a die 213 is detachably provided in the machining unit body 201. Numeral 206 denotes a hydraulic cylinder provided on the upper end of the machining unit body 201 and connecting the rod 212 of a piston (not shown) to the punch 212. Numeral 207 denotes a position detecting device for detecting the position of the piston in the hydraulic cylinder 206, that is, the position of the punch 212.

Numeral 20 denotes a hydraulic unit having a low-pressure pump 22 and a high-pressure pump 23, both driven by a motor 21 to supply operating fluid to the hydraulic cylinder 206, etc. from an oil tank 24 via a hydraulic circuit, which will be described later. The low-pressure pump 22 and the high-pressure pump 23 are formed into a variable-capacity type. Numeral 25 denotes a high-pressure hydraulic circuit, in which an accumulator 30 is provided to connect the high-pressure pump 23 and the hydraulic cylinder 206 via a check valve 26, selector valves 27 and 28. Next, numeral 29 denotes a low-pressure hydraulic circuit in which the low-pressure pump 22 and the hydraulic cylinder 206 are connected via check valves 31 and 32, and a selector valve 28. Numeral 33 denotes a return circuit connecting the selector valve 28 and the oil tank 34. The selector valves 27 and 28 are connected to a control device (not shown) which is operated by signals from the position detecting device 207 so as to operate corresponding to the top and bottom positions of a piston (not shown) of the hydraulic cylinder 206, that is, the top and bottom positions of the punch 212. The other machining units 300 and 400 are also formed in the same manner as described above.

Next, the operation of the embodiment having the aforementioned construction will be described. In FIG. 5, the punch 212 is in the top position, representing the state before machining operation. As the hydraulic unit 20 is operated, the operating fluids from the low-pressure pump 22 and the high-pressure pump 23 are supplied to the low-pressure hydraulic circuit 29 and the high-pressure hydraulic circuit 25, respectively. It is assumed that the selector valve 27 is thrown to the left, and that the operating fluid in the high-pressure hydraulic circuit 25 is on standby. As a result, the operating fluid in the low-pressure hydraulic circuit 29 is supplied to the upper part of the hydraulic cylinder 208 via the selector valve 28, and the punch 212 is brought close to the surface of the workpiece 2 by the action of the piston (not shown). In this state, the selector valve 27 is moved to the right to the state shown in FIG. 5 via the control device (not shown) by the signal from the position detecting device 207. This causes the hydraulic pressure in the high-pressure hydraulic circuit 25 to be transmitted to the upper part of the hydraulic cylinder 206 via the selector valves 27 and 28, and thereby notching operation is performed on the workpiece 2 by the punch 212 and the die 213. In this case, the high-pressure operating fluid is not fed to the low-pressure hydraulic circuit 29 due to the existence of the check valve 32.

Next, as the punch 212 reaches the bottom position, the selector valve 27 is moved to the left and the selector valve 28 to the right via the control device by the signal from the position detecting device 207. As a result, the supply of operating fluid in the high-pressure hydraulic circuit 25 to the hydraulic cylinder 206 is shut off, and at the same time, the operating fluid in the low-pressure hydraulic circuit 29 is supplied to the lower part of the hydraulic cylinder 206 via the selector valve 28, causing the punch 212 to be lifted. The punch 212 is then engaged with a stopper (not shown), and stopped at the top position. In this way, machining in the other machining units 300 and 400 is completed, and their respective machining means reach the top positions. The workpiece 2 is then index-fed to the left to repeat the next machining operation.

In this embodiment, description has been made about the case where hydraulic cylinders are used as the driving means of machining units. Needless to say, air, water and other fluids may be used as the pressure medium. Moreover, known position detecting devices other than the electrical type may be used as the position detecting means. In the embodiment, although the selector valves are used as a control means of the hydraulic circuits, flow control valves may of course be used.

Figure 6:
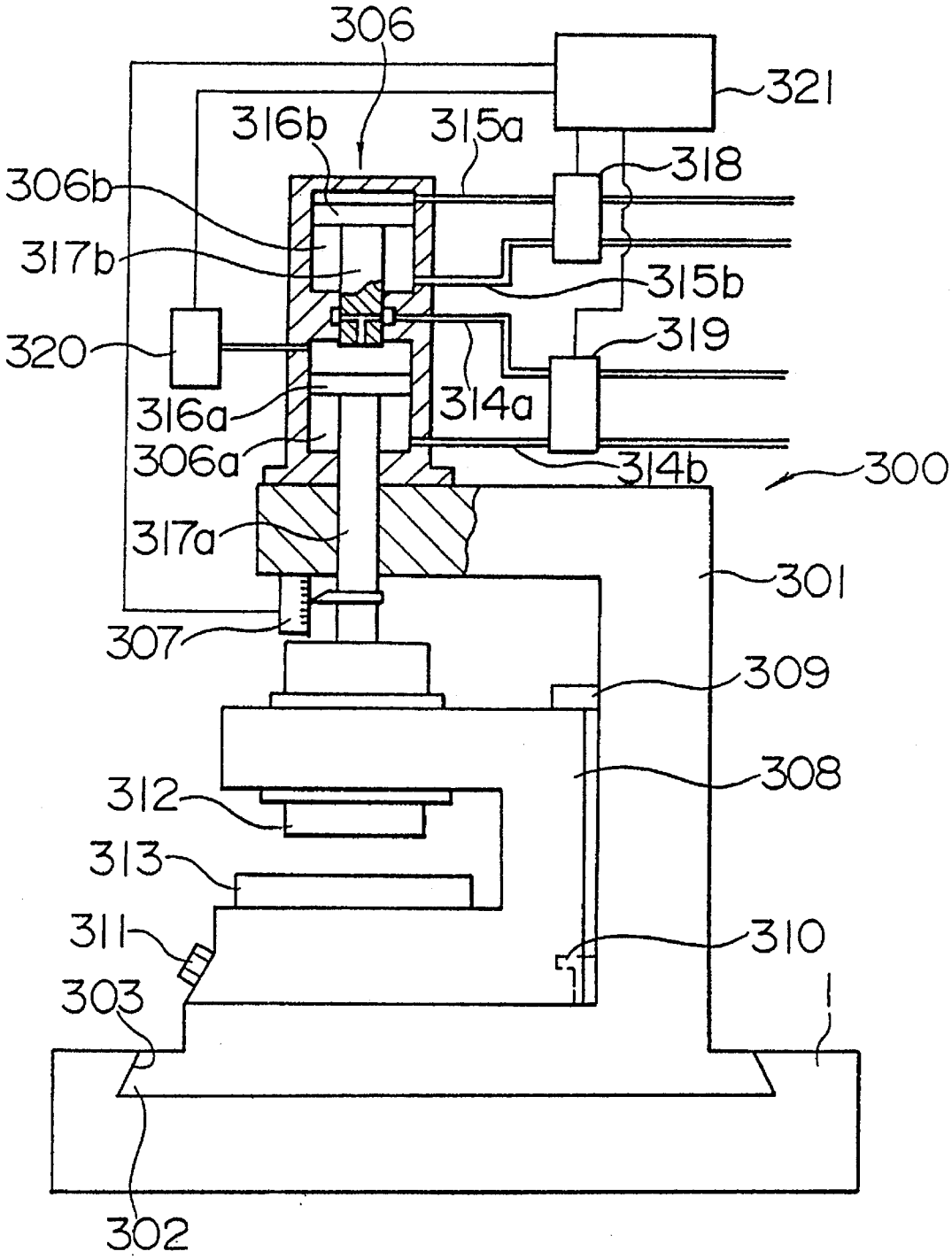
FIG. 6 is a partly cross-sectional diagram of assistance in explaining the fourth embodiment of this invention.

FIG. 6 is a partly cross-sectional diagram of assistance in explaining the fourth embodiment of this invention. Like parts are indicated by like numerals used in FIGS. 1, and 2A and 2B. In FIG. 6, the machining unit body 301 of a machining unit 300 is mounted on a base 1 by engaging a dovetail 302 with a dovetail groove 303 provided on the base 1, and fixedly fitted by means of a clamp device (not shown). A cassette 308 has a punch 312 formed in a vertically movable manner, and a die 313 forming a pair with the punch 312, and is detachably mounted on the machining unit body 301. Numeral 306 denotes a hydraulic cylinder, and 307 a position measuring device provided on the upper end of the machining unit 301.

The hydraulic cylinder 306 is constructed by connecting in series a first cylinder 306*a* constituting the succeeding stage to a second cylinder 306*b* constituting the preceding stage; with pistons 316*a* and 316*b* being fitted thereto. A piston rod 317*a* is connected to the punch 312, and a piston rod 317*b* is formed in such a manner that it can enter into the first cylinder 306*a*. The first cylinder 306*a* and the second cylinder 306*b* are constructed so that hydraulic pressure can be applied simultaneously or individually to the first cylinder 306*a* and the second cylinder 306*b* via pipings 314*a*, 314*b*, 315*a* and 315*b* to which an oil-flow control valve 318 and a selector valve 319 is fitted. The piping 314*a* is formed in such a manner that fluid can be led to the first cylinder 306*a* via an opening provided on the piston rod 317*b*. Numeral 320 denotes a pressure sensor for detecting the hydraulic pressure in the first cylinder 306*a*. Numeral 321 denotes a control device that can control the oil-flow control valve 318 and the selector valve 319 on the basis of signals from the position measuring device 307 and/or the pressure sensor 320.

Figure 7:
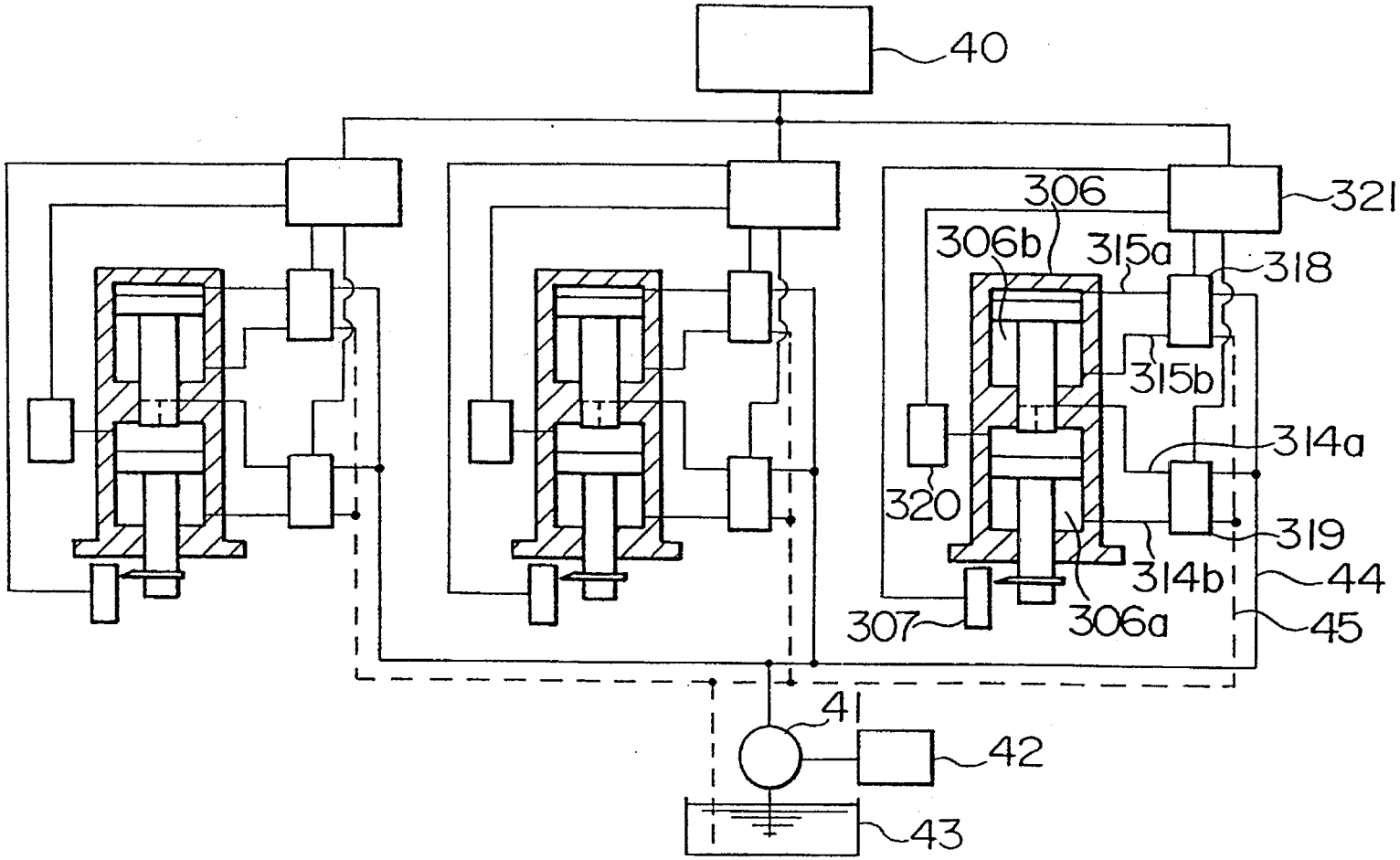
FIG. 7 is a hydraulic circuit diagram in the fourth embodiment of this invention shown in FIG. 6.

FIG. 7 is a hydraulic circuit diagram in an embodiment of this invention. Like parts are indicated by like numerals used in FIG. 6. FIG. 7 shows the case where three sets of hydraulic cylinders 306 of the same construction. The strokes of the piston rods 317*a* and 317*b* can be set to different values. In FIG. 7, numeral 40 denotes an operation control device to which three pieces of control devices 321 are connected in a controllable manner. Numeral 41 denotes a hydraulic pump of the variable capacity type driven by a motor 42. Operating fluid is adapted to be supplied from an oil tank 43 to the hydraulic cylinder 306 via a hydraulic piping 44, the oil-flow control valve 318 and the selector valve 319. Numeral 45 denotes a return piping.

With the aforementioned construction, the operation of the embodiment will be described, referring to FIGS. 6 and 7. As the hydraulic pump 41 is operated by the motor 42, operating fluid is supplied from the hydraulic piping 44 to the hydraulic cylinder 306. The selector valve 319 is thrown to a positive position, and the oil-flow control valve 318 is brought to the closed state. Thus, the operating fluid from the hydraulic piping 44 is supplied from the piping 314*a* and the opening of the piston rod 317*b* to the upper part of the first cylinder 306*a* via the selector valve 319. This causes the piston 316*a* to be lowered, and the punch 312 connected to the piston rod 317*a* performs drawing operation on the workpiece, as shown in FIG. 2B.

If an even larger driving force is required in the final stage of drawing operation, that is, when the piston 316*a* and the piston rod. 317*a* in the first cylinder 306*a* reach their respective predetermined positions, the oil-flow control valve 318 is brought to the opened state via a control device based on the detection signal of the position measuring device 307, causing the operating fluid in the hydraulic piping 44 to be supplied from the piping 315*a* to the second cylinder 306*b*. Thus, the piston rod 317*b* connected to the piston 316*b* enters into the first cylinder 306*a*.

As the piston rod 317 is lowered, the opening of the piping 314*a* is closed, bringing the operating fluid in the upper part of the first cylinder 306*a* to the sealed state. As a result, the pressure of the operating fluid in the first cylinder 306*a* is boosted, exerting a large pushing force to the piston rod 317*a* as the piston rod 317*b* enters into the first cylinder 306*a*. When it is assumed that the cross-sectional areas of the piston 316*b* and the piston rod 317*b* are $A_1$ and $A_2$, the pressure of the operating fluid in the first cylinder 306*a* can be increased to $A_1/A_2$ times as the piston rod 317*b* enters into the first cylinder 306*a*. Consequently, if the pressure of the operating fluid in the hydraulic piping 24, for example, is 140 kg/cm$^2$, and $A_1/A_2=3$, the pressure of the operating fluid in the first cylinder 306*a* can be increased to 420 kg/cm$^2$.

When the piston 316*a* is lowered in the aforementioned state, the inner volume of the first cylinder 306*a* is increased. The pressure of the operating fluid in the first cylinder 306*a* will be dropped unless the piston rod 317*b* is pushed into the first cylinder 306*a* by the increment of the inner volume thereof. To cope with this, the pressure in the first cylinder 306*a* is detected by the pressure sensor 320, and the detection signal is input to the control device 321 to replenish the volume of oil in the second cylinder 306*b*. If the amount of oil cannot be replenished even when the piston rod 317*b* is brought into the first cylinder 306*a* only once, the oil-flow control valve 318 is brought to the opposite position by the control device 321 to lift the piston 316*b*, thereby introducing operating fluid into the first cylinder 306*a* through the piping 314*a* and the opening of the piston rod 317*b* to repeat the operation of causing the piston rod 317*b* into the first cylinder 306*a*. In this way, control is effected by the pressure sensor 320 to keep the pressure in the first cylinder 306*a* at a predetermined value.

Next, as the punch 312 as shown in FIG. 6 reaches the bottom position, the oil-flow control valve 318 is brought to the opposite position via the control device 321 by the signal from the position measuring device 307, shutting off the supply of operating fluid from the piping 315*a*, while the operating fluid in the upper part of the second cylinder 306*b* is returned into the oil tank 43 through the return piping 45 as shown in FIG. 7 via the oil-flow control valve 318. At the same time, since operating fluid is supplied from the piping 315*b* to the lower part of the second cylinder 306*b*, the piston 316*b* and the piston rod 317*b* are lifted and stopped at the top position. In this case, the operating fluid in the upper part of the first cylinder 306*a* remains in the sealed state until the opening provided on the piston rod 317*b* is aligned with the opening of the piping 314*a*. So the pressure is gradually decreased as the piston rod 317*b* is lifted, and the pressure is returned to the initial value when the piston rod 317*b* reaches the top position. At the same time, the selector valve 319 is brought to the opposite position, and the operating fluid in the upper part of the first cylinder 306*a* is returned to the oil tank 43 from the return piping 45 shown in FIG. 7 through the piping 314*a*, while operating fluid is supplied to the lower part of the first cylinder 306*a* through the piping 314*b*. Thus, the piston 316*a* shown in FIG. 6 is lifted and stopped at the top position. After machining operations in the other machining units are completed, and their respective machining means reach the top positions in this way, the workpiece 2 is index-fed to the left in FIGS. 2A and 2B to repeat the next operation.

Figure 8:
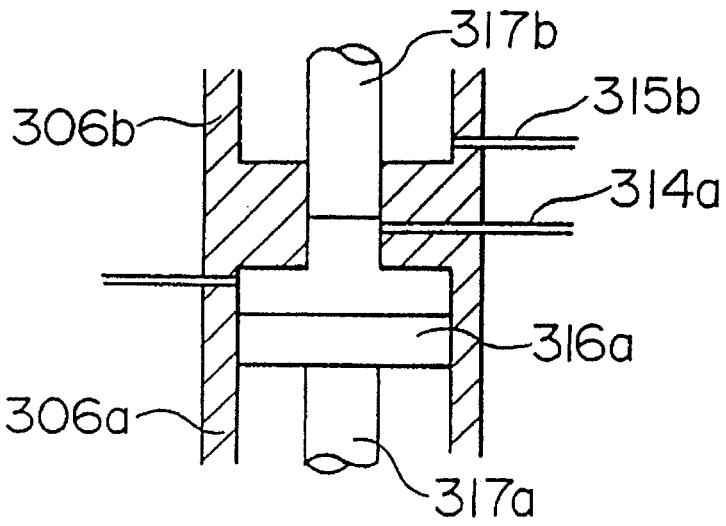
FIGS. 8 and 9 are enlarged sectional views illustrating a variation of the hydraulic cylinder 306 shown in FIG. 6.
Figure 9:
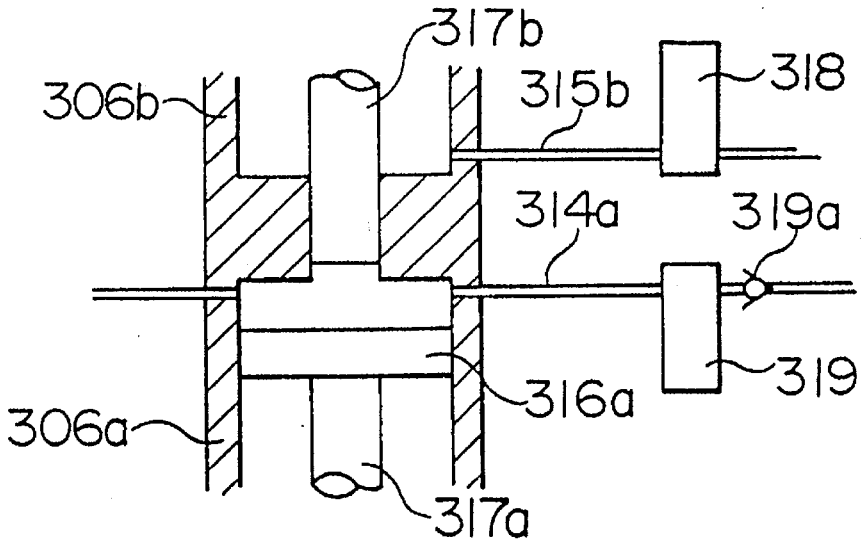

FIGS. 8 and 9 are enlarged longitudinal sectional views illustrating a variation of the hydraulic cylinder 306 shown in FIG. 6. Like parts are indicated by like reference numerals used in FIG. 6. The hydraulic cylinder shown in FIG. 8 is formed in such a manner that operating fluid is introduced into the first cylinder 306*a* from the piping 314*a* when the piston rod 317*b* is almost at the top position; and that the opening of the piping 314*a* is closed as the piston rod 317*b* is lowered. With this arrangement, the pressure of operating fluid in the first cylinder 306*a* can be boosted as the piston rod 317*b* enters into the first cylinder 306*a*.

The hydraulic cylinder shown in FIG. 9 has such a construction that the opening of the piping 314*a* is provided in the upper part of the first cylinder 306*a*, and a check valve 319*a* is provided on the piping 314*a*. With this arrangement, the pressure of operating fluid can be boosted, as in the case of the hydraulic cylinder shown in FIG. 8 because the operating fluid supplied to the first cylinder 306*a* is shut off as the piston rod 317*b* is lowered.

In this embodiment, although description has been made about the case where hydraulic cylinders are used as the driving means of machining units, air, water and other fluids may be used as the pressure medium. Description has also been made about the two-stage construction of hydraulic cylinders, but three or more stages of hydraulic cylinders may be used, depending on the required power for driving means. In general, the construction of the n-stage fluid-pressure cylinders may be such that the actuator of the piston member fitted in the fluid-pressure cylinder of the (n−1)-th stage enters into the succeeding n-th stage fluid-pressure cylinder.

In place of the forefront-stage fluid-pressure cylinder, an actuator driven by an electromagnet or other mechanical means may be used. As the position detecting device, known position detecting means other than the electrical type may be used. Furthermore, selector valves are used as the control means of hydraulic circuits in the embodiments described above, but flow-control valves may be used instead.

This invention having the aforementioned construction and operation can achieve the following effects.

(1) By using driving means of almost the same capacity, the energy balance of the entire system can be maintained properly, and the driving power of any machining unit can be selectively increased.

(2) Since no custom-made driving means are required, manufacturing cost can be reduced; and since machining can be performed by driving means having the required minimum capacity, high energy efficiency can be achieved.

(3) Since either of high and low fluid pressures can be selectively applied to fluid-pressure cylinders so that low fluid pressure is used for moving machining means, and high fluid pressure is used for machining only, the consumption of high-pressure operating fluid can be reduced to the minimum, and energy consumption can be reduced.

(4) Since the operating position of a fluid-pressure cylinder is controlled for each machining unit, the consumption of operating fluid can be reduced and the time required for machining can also be reduced.

(5) Since the top position, operating point, bottom position can be positioned freely, and points at which fluid pressure is changed can be controlled; a particular section can be switched to high or low fluid pressure, for example, extremely efficient machining operations can be accomplished.

(6) By using flow-control valves to control fluid circuits, the magnitude and direction of driving force can be freely controlled. That is, machining means can be controlled through the digital flow control, or NC means.

(7) As the construction of this invention is such that a multi-stage cylinder is operated only when a larger driving force is required for machining, high-pressure operating fluid need not be prepared separately, and energy consumption can be reduced.

What is claimed is:

1. An index-feed machining system comprising:

a base;

a plurality of machining units positioned on said base, each of said plurality of machining units including a machining means for machining a workpiece, said each machining unit also including a driving means for driving said machining means, each of said driving means in a subset of said machining units being formed by first and second fluid-pressure cylinders connected in series, each of said first and second fluid pressure cylinders being selectively drivable and having a movable piston and piston rod, said piston rod of said first fluid-pressure cylinder being in contact with said machining means, and said piston of said first fluid-pressure cylinder being positioned inside said first fluid-pressure cylinder, said piston of said second fluid-pressure cylinder being positioned inside said second fluid-pressure cylinder, said piston rod of said second fluid-pressure cylinder being movable into said first fluid-pressure cylinder, a cross sectional area of said piston of said second fluid-pressure cylinder being larger than a cross sectional area of said piston rod of said second fluid-pressure cylinder, said first fluid pressure cylinder includes a valve means cooperating with movement of said piston rod of said second fluid-pressure cylinder for containing fluid in said first fluid-pressure cylinder when said piston rod of said second fluid-pressure cylinder enters said first fluid-pressure cylinder.

2. A machining system in accordance with claim 1, wherein:

each of said machining units includes a control means for controlling fluid flow into said first and second fluid-pressure cylinders in such a manner that when said piston of said second fluid-pressure cylinder reaches a predetermined position, a predetermined fluid pressure can be applied to said first fluid-pressure cylinder.

* * * * *